US005765991A

United States Patent [19]

Blotenberg

[11] Patent Number: 5,765,991

[45] Date of Patent: Jun. 16, 1998

[54] PROCESS AND DEVICE FOR OPERATING DYNAMIC-TYPE COMPRESSORS WITH REGULATORS WITH HIGH PROPORTIONAL AMPLIFICATION

[75] Inventor: Wilfried Blotenberg, Dinslaken, Germany

[73] Assignee: MAN Gutehoffnungshutte Aktiengesellschaft, Oberhausen, Germany

[21] Appl. No.: 681,919

[22] Filed: Jul. 29, 1996

[30] Foreign Application Priority Data

Aug. 1, 1995 [DE] Germany ..... 195 28 253.1

[51] Int. Cl.[6] ..... F04D 27/00

[52] U.S. Cl. ..... 415/26; 415/27

[58] Field of Search ..... 415/26, 27, 28, 415/17

[56] References Cited

U.S. PATENT DOCUMENTS

| | | | |
|---|---|---|---|
| 4,656,589 | 4/1987 | Alberts et al. | 415/17 |
| 4,789,298 | 12/1988 | Blotenberg | 415/27 |
| 4,936,740 | 6/1990 | Blotenberg | 415/27 |
| 4,936,741 | 6/1990 | Blotenberg | 415/27 |
| 4,938,658 | 7/1990 | Blotenberg | 415/27 |
| 4,944,652 | 7/1990 | Blotenberg | 415/27 |
| 4,946,343 | 8/1990 | Blotenberg | 415/27 |
| 4,948,332 | 8/1990 | Blotenberg | 415/27 |
| 4,968,215 | 11/1990 | Blotenberg | 415/27 |

*Primary Examiner*—John T. Kwon
*Attorney, Agent, or Firm*—McGlew and Tuttle

[57] ABSTRACT

A process and a device for avoiding regulator instabilities in surge limit regulators for protecting a turbocompressor from surging if a high proportional gain is selected for the surge limit regulator by a blow-off via a blow-off valve. The control of the velocity of closing of the blow-off valve over time is performed by a gradient limiter of asymmetric design, wherein no velocity limitation acts in the opening direction, but a freely parameterizable velocity limitation of the closing process of the blow-off valve is provided in the closing direction. The gradient limiter is inserted between the surge limit regulator, which receives the control signals on the actual value of flow and the desired value of flow from a subtracter, and the control line for a pneumatic or hydraulic operating device of the blow-off valve.

18 Claims, 2 Drawing Sheets

PROCESS AND DEVICE FOR OPERATING DYNAMIC-TYPE COMPRESSORS WITH REGULATORS WITH HIGH PROPORTIONAL AMPLIFICATION

FIELD OF THE INVENTION

The present invention pertains to a process and a device for operating dynamic-type compressors for avoiding regulator instabilities with high proportional amplification of the regulator, wherein a control parameter is determined in the process from measured values at least for the flow through the compressor and the compressor discharge pressure as well as from preset or presettable desired values, and an immediate opening of the blow-off or recycle valve is performed by an anti-surge regulator on the basis of the said control parameter by means of a pneumatic or hydraulic operating device via a pressurized medium.

BACKGROUND OF THE INVENTION

Surge limit regulators are characterized in that they require especially rapidly opening control valves.

It has been known from the technical literature that equal adjusting dynamics of the control valves with the shortest possible travel times in the opening direction is necessary to achieve a good regulator stability. This means that a blow-off valve, which must open rapidly due to the requirements of the process, must also close rapidly to achieve a good regulator stability.

It was determined in practice that a certain asymmetry between the velocities of opening and closing is not disturbing. Thus, throttles have always been installed in the oil circuits of hydraulic surge limit blow-off valves or in the instrument air supply line of pneumatic blow-off or recycle valves. Since the drives of these blow-off valves are generally designed such that a spring opens the blow-off valve and the closing of the blow-off valves is achieved by oil or air pressure, control medium (oil or air) is gradually shut off and drained or vented for opening the blow-off valves, but control medium is fed in from the supply line for closing. If it is ensured by design measures that the free cross sections are very large in the opening direction, but a throttling point is provided in the closing direction, an asymmetric adjusting behavior is obtained. This adjusting behavior is utilized to avoid damage to the machine due to rapidly closing blow-off valves. The throttles are dimensioned, as a rule, such that the blow-off valve is moved from the fully opened into the fully closed position in about 20 sec.

The only task of these throttles is to avoid, in the case of a manual intervention in the control circuit, that the blow-off valves close in 1–2 sec because of an operating error, as a result of which the turbocompressor could reach the unstable range. In contrast, if the blow-off valves close in 20 sec, the operating personnel still has sufficient opportunity even in the case of an operating error to correct the operating error before the blow-off valve is fully closed.

It is obvious that the throttling points in the supply line of the control medium cannot become arbitrarily small. If the throttling points are too narrow, there is a risk that narrow cross sections become clogged by small dirt particles, and as a result, the blow-off valve will not be adjusted at all. Closing times exceeding 20 sec for the entire closing stroke are therefore practically unfeasible.

It was found in practice that this asymmetry is not unacceptably harmful for the regulating behavior and the regulator stability.

A surge limit regulator, which has a nonlinear amplifier, variable gain has been known from DE 26 23 899. This nonlinear amplifier increases the gain of the control circuit by a factor of 5 when the blow-off valves are exceeded by more than 2%. Since the surge limit regulators are operated with the maximum allowable gain, this increased gain by 5 means that the regulator operates in an unstable manner at this high gain.

Another essential improvement in the overall behavior of the control circuit is achieved by using a tracking integral regulator. This process is described in DE 38 09 881. The output of the regulator is always compared with the current position of the blow-off valve.

The control deviation e used in the regulation process is defined as the difference between the desired value of the flow, W, and the actual value of the flow, X, i.e., $e=W-X$. A negative sign of the control deviation e consequently means that the working point of the compressor is located in the safe working range, while a positive sign of the control deviation e means that the working point has exceeded the blow-off line to the left, i.e., in the direction of the surge limit. If the working point exceeds the surge limit, surging of the compressor will take place. If position differs too much from the valve setpoint, the regulator is switched to tracking operation, and its output is switched over to the current blow-off or recycle valve position. It is ensured as a result that the controller output of the surge limit regulator does not substantially deviate from the position of the valve.

There have been known applications in which the position of the valve is not measured or is not available within the regulation. To prevent the "divergence" of the regulator output and the limited correcting variable in these cases as well, it is also possible to report the limited correcting variable back to the regulator instead of reporting back the current valve position. This ultimately leads to the same results as the reporting back of the valve position.

The behavior of the surge limit regulator is determined essentially by its proportional amplification in the case of rapid process disturbances. The higher the proportional amplification selected, the greater is the change in the regulator output signal and consequently in the position of the blow-off valve. A blow-off valve opening more widely is more likely to be able to protect a compressor from surging than is a blow-off valve opening only slightly.

However, the proportional amplification cannot be selected to be as high as arbitrarily desired, because this would lead to instabilities of the control circuit. The cause of these instabilities is the inevitable delays in the control system.

SUMMARY AND OBJECTS OF THE INVENTION

Therefore, the primary object of the invention arises that a process of the type described here should be improved such that the regulating behavior of a turbocompressor is improved by the proportional amplification being able to be appreciably increased without the control circuit becoming unstable or without the control member (blow-off or recycle value valve) tending to vibrate.

According to the invention, a process is provided for operating dynamic-type compressors for avoiding regulator instabilities in surge limit regulations with high proportional gain of the regulator by means of blow-off via a blow-off valve. The process involves determining a control parameter from measured values at least for the flow through the compressor and for the compressor discharge pressure as well as from preset or presettable desired values, and immediate opening of the blow-off valve takes place on the basis of the control parameter by a surge limit regulator by means of a pneumatic or hydraulic operating device via a pressurized medium. An electronic limitation of the velocity of closing of the blow-off valve is performed by employing a gradient limiter of asymmetric design (an asymmetric gradient limiter). No time limitation acts in the opening direction of the said blow-off valve. A freely parameterizable limitation of the closing velocity of the said blow-off valve is provided or programmed in the closing direction.

Preferably, the process provides a higher velocity of closing by the reversible gradient limiter at a greater distance between the working point and the surge limit, and a lower velocity of closing of the blow-off valve is reached in the vicinity of the surge limit. The velocity of closing is preferably reduced stepwise by the gradient limiter with a plurality of switching steps as the working point approaches the blow-off line. The velocity of closing of the blow-off valve is preferably continuously reduced by a continuously variable limit value of the gradient as the working point approaches the blow-off line. The position of the blow-off valve is preferably fed back to the surge limit regulator. The signal of the control line is preferably fed back to the surge limit regulator.

According to a further aspect of the invention, a device is provided for carrying out the process. The device has a surge limit regulator for adjusting a blow-off valve via a pressure medium by means of a pneumatic or hydraulic operating device with a position regulator with a piston-and-cylinder unit or with a membrane-and-cylinder unit, as well as with a control line for operating the blow-off valve as needed in the opening and closing directions. An electronic gradient limiter is inserted between the surge limit regulator and the said control line.

The gradient limiter preferably comprises a gain, a limiter, and an integrator. A feedback line preferably branches off to the gain after the integrator. A return line is preferably provided for displaying the valve position and is arranged between the said pneumatic/hydraulic operating device of the said blow-off valve and the surge limit regulator. The control line is preferably coupled with the return line via the pneumatic/hydraulic operating device Slow closing and rapid opening of the blow-off valve are achieved due to an asymmetry for the adjusting behavior of the blow-off valve.

The stability behavior of surge limit regulator circuits can be favorably influenced according to the present invention by performing an electronic limitation of the velocity of closing of the blow-off valve. As a consequence, surge limit regulators with markedly higher proportional amplification can be operated in a stable manner. An electronic gradient limiter is installed for this purpose in the output of the surge limit regulator. This gradient limiter has an asymmetric design, i.e., there is no velocity limitation acting in the opening direction of the blow-off valve, but a freely parameterizable velocity limitation of the closing process of the blow-off valve is provided or programmed in the closing direction.

The best practical results were obtained with opening times of 1 sec and closing times of more than 5 sec. Closing times of 10 minutes or longer can be readily set with this embodiment.

A surge limit regulation with such a gradient limitation is extensively independent from very high regulator gains. A very high regulator gain selected inherently leads to the control circuit becoming unstable. Without this limitation, the regulator output and consequently the valve position would oscillate. However, this oscillation would be limited with this limitation in the regulator output to the first half-wave, i.e., even though the excessively high gain would open the blow-off valve more widely than would an optimally set regulator, the subsequent rapid closing process would fail to materialize, and the valve would close with the gradient set only, i.e., slowly.

The time needed to bring the blow-off valve into the desired target position is sufficient in practice to cause the process disturbance that has caused the regulator deflection to fade away. Should this not happen, a repeated intervention of the regulator in the direction of valve opening may take place. This will then lead to the valve repeatedly performing a violent opening movement and the above-described process being repeated once again. The disturbance fades away after a few deflections of the regulator in most cases. The freely settable gradient in the closing direction of the valve, which can be selected to be such that this requirement will be met, is available here as a degree of freedom.

If the proportional amplification is set too high and the gradients selected are incorrect, this may lead to the failure of a compensation to take place and to the process described being periodically repeated. Without the expansion according to the present invention, such a process leads to very violent continuous oscillations of a period of, e.g., 1–3 sec and of high amplitude. If a closing time of, e.g., 10 minutes is selected with the process according to the present invention, and the blow-off valve performs a stroke of 10% during the unstable process, this means that the duration of the period increases to 1 minute. Such an instability, which takes place, in addition, according to a sawtooth pattern, is considerably much more acceptable from the viewpoint of process technology than a 1–3-sec oscillation with considerably greater valve stokes. The principal advantage of the present invention is that it is possible to select markedly higher proportional gains. As a result, the surge limit regulator intervenes markedly more strongly in the case of a process disturbance and it protects the compressor from surging considerably better.

The correcting variable limiter must be considered to be a functional block, whose output is always the same as its input in the case of stationary operation. This also applies to dynamic processes in the direction of valve opening. Control commands in the closing direction are also switched through to the output unaffected by the input as long as the gradient for changing the correcting variable is smaller than the limit value set. If this change in the input takes place with a steeper gradient, the output variable changes with the gradient set as a parameter until the gradient of the input becomes smaller than the limit set.

In another embodiment of the present invention, the gradient can be made reversible. This becomes necessary when a high velocity of closing is permitted at a greater distance between the working point and the surge limit and switchover to a lower velocity is performed in the vicinity of the surge limit. This situation occurs when the working point is located, e.g., more than 20% from the blow-off line, in which case the valve can close at an adjusting time of, e.g., 20 sec or even 1 sec for the entire stroke; however, if the working point is coming closer to the blow-off line and drops below the 20% limit, the adjusting time is switched over to, e.g., 5 minutes for the entire stroke.

It is also possible according to the present invention to use a plurality of switching steps or even a continuously variable limit value for the gradient, which is a function of the control deviation, the distance between the working point and the blow-off line.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
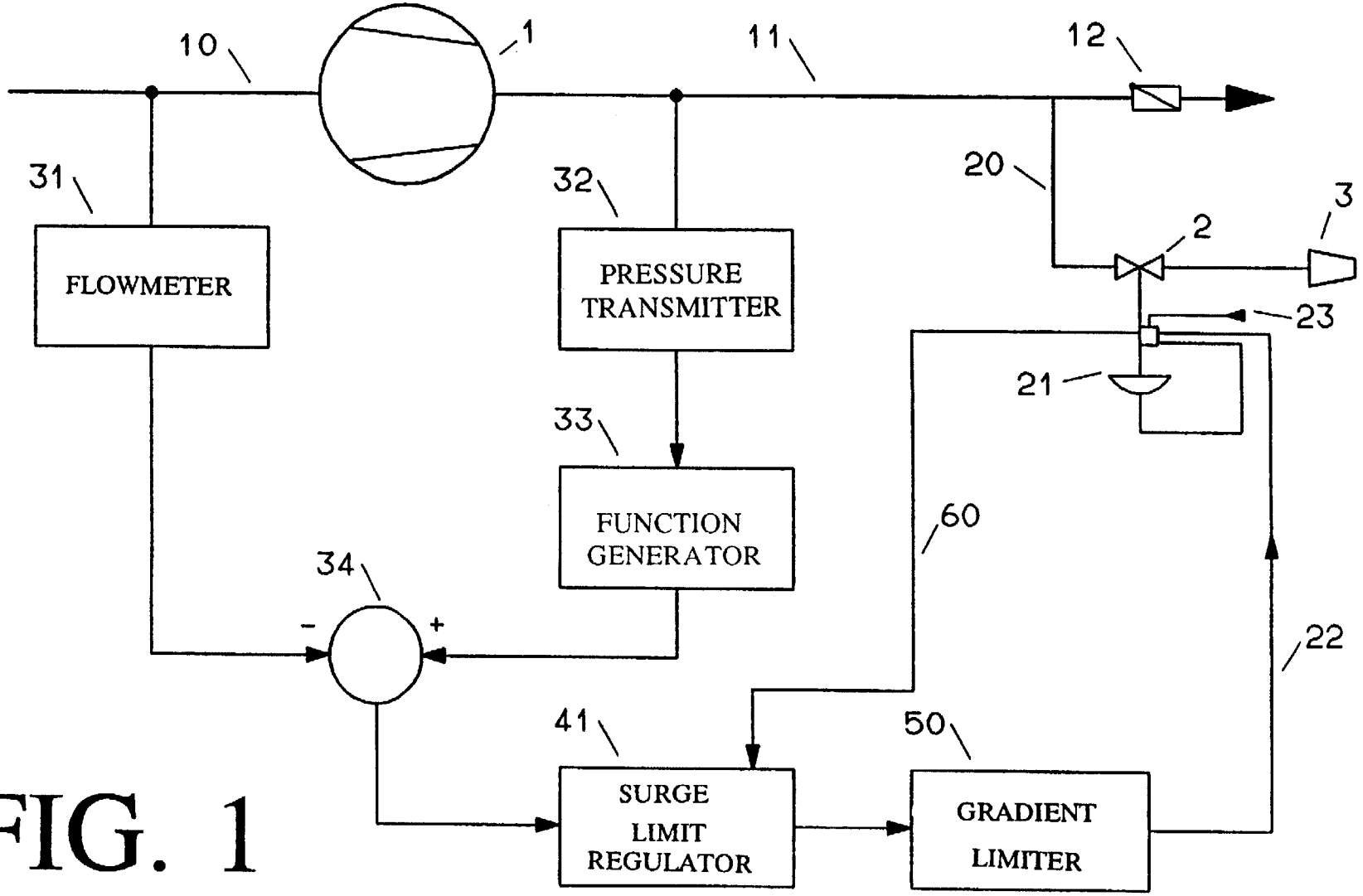
FIG. 1 is a schematic circuit diagram of a circuit according to the invention for avoiding regulator instabilities.

Referring to the drawings in particular, FIG. 1 schematically shows a turbocompressor 1 which is connected on the suction side to a suction line 10. On the discharge side, the turbocompressor 1 is connected to a discharge line (exhaust gas line), which sends the medium compressed by the turbocompressor 1 to a process taking place downstream via a nonreturn valve 12. A blow-off line 20 is branched off from the discharge line 11 before the nonreturn valve 12, and a blow-off valve 2 with a sound absorber 3 and with a pneumatic or hydraulic operating device 21, which is connected to a control line 22, is connected into the said blow-off line 20.

The flow of the medium to be compressed, which flows to the compressor 1, is measured on the suction side by means of a flowmeter with transmitter 31 connected to the suction line 10. The compressor discharge pressure can be determined by means of a pressure transmitter 32 connected to the discharge line 11. The pressure gauge 32 is followed by a function generator 33, which issues the minimum flow value that is still just permissible for the compressor 1 at a certain pressure, on the basis of stored data (pressure/flow relationship characteristic). The actual value of flow currently measured by the flowmeter 31 and the desired flow value issued by the function generator 33 are fed into a subtracter 34, in which their difference is formed by subtracting the actual value from the desired value.

The control parameter generated in the subtracter 34 is sent to a surge limit regulator 41, which is arranged downstream of the subtracter 34.

The surge limit regulator 41 ensures continuous regulation, i.e., an exact adjustment of the blow-off or recycle valve 2 as a function of the position of the working point in the characteristic diagram. To achieve this, the output of the surge limit regulator 41 acts on the operating device 21 of the blow-off valve 2 via a gradient limiter 50 and via a control line 22.

A pressurized medium supply line 23 leads to the operating device (actuation unit) 21 with a position regulator to a piston-and-cylinder unit or a membrane unit, not specifically shown, for generating the force for the adjusting movement of the blow-off valve 2 in the closing and opening directions. The force for the adjusting movement of the blow-off valve 2 in the opening direction is generated, for safety reasons, in general, by means of a force storage element, e.g., a tensioned spring, in order to ensure the automatic opening of the blow-off valve 2 in the case of failure of the regulation.

The output of the control line 22 acts on a pneumatic or hydraulic operating device 21. The blow-off valve 2 is adjusted as a result in the opening direction in the case of a process disturbance due to the reduction of the control signal until the compressor working point has again returned into the safe range of the characteristic diagram at a velocity of adjustment that depends only on the design of the valve 2 and the drive 21.

Should the surge limit regulator 41 respond too violently and should the blow-off valve 2 have opened too wide, the output signal of the surge limit regulator 41 increases again. The gradient limiter 50 limits the increase in the control signal 22 to the limit value set, and thus it brings about a delayed closing of the blow-off valve 2 from the position last reached.

To prevent the output signal of the surge limit regulator 41 from unacceptably preceding the position of the valve 2 during an intervention of the gradient limiter 50, the position of the valve 2 is fed back to the surge limit regulator 41 via the return line 60. The surge limit regulator 41 now internally limits its output variable by tracking the valve position. In the absence of position measurement at the valve 2, the control signal 22 can also be returned to the surge limit regulator 41.

Figure 2:
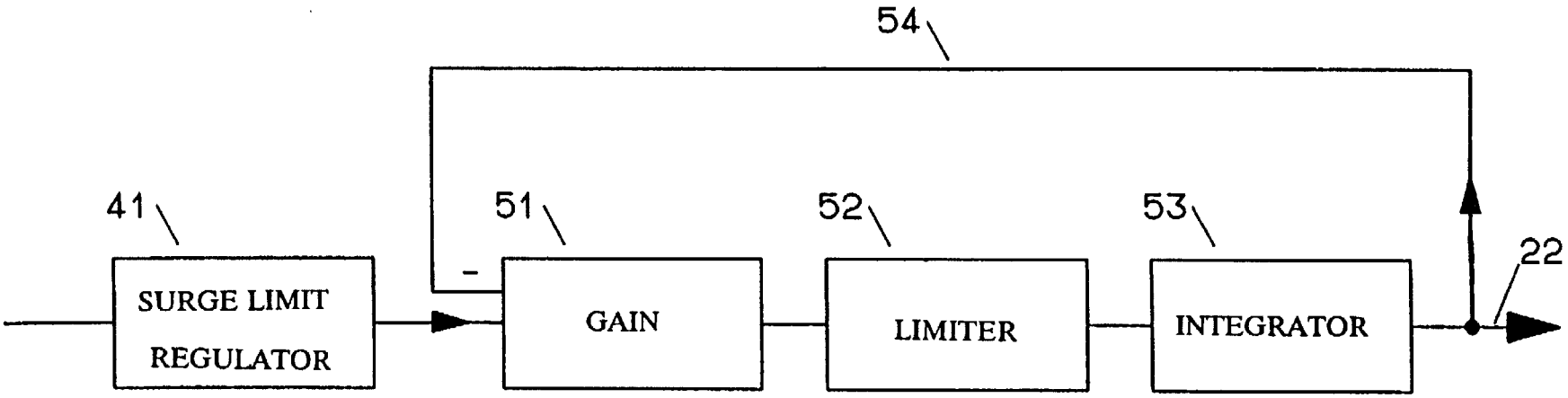
FIG. 2 is schematic a circuit diagram of the electronic gradient limiter.

The electronic gradient limiter 50 according to the present invention is shown in detail in FIG. 2. It comprises the signal input unit, a gain 51, a limiter 52, as well as an integrator 53. A feedback line 54, which is directly connected to the gain 51, branches off from the control line 22 after the integrator 53. The limit values for the gradients are set as upper and lower limit values of the limiter 52.

Prior-art components may be used for the gradient limiter 50 and the surge limit regulator 41, so that the process can be carried out and a device suitable for it can be manufactured in a relatively simple manner and at low cost.

While specific embodiments of the invention have been shown and described in detail to illustrate the application of the principles of the invention, it will be understood that the invention may be embodied otherwise without departing from such principles.

What is claimed is:

1. A process for operating a dynamic-type compressor for avoiding regulator instabilities in surge limit regulations with high proportional amplification of the regulator, the process comprising the steps of:

regulating the compressor to avoid compressor surge by means of blow-off via one of a blow-off and a recycle valve;

determining a control parameter from measured values at least for the flow through the compressor and from the compressor discharge pressure as well as from preset or presettable desired values, wherein said control parameter is based on a compressor surge limit;

during said regulating providing for immediate opening of the blow-off or recycle valve with an operating device on the basis of said control parameter by a surge limit regulator controlling said operating device via a pressurized medium, said operating device being one of a pneumatic and hydraulic operating device;

electronically limiting a velocity of closing of said blow-off valve by employing a gradient limiter of asymmetric design, wherein no gradient limitations act in the opening direction of said blow-off valve, but a freely parameterizable gradient limitation of the closing process of said blow-off valve is one of provided and programmed in the closing direction of said blow-off valve.

2. A process in accordance with claim 1, wherein a higher velocity of closing is caused by a reversible gradient limiter at a greater distance between a working point and the surge limit, and a lower velocity of closing of said blow-off valve is used in the vicinity of the surge limit.

3. A process in accordance with claim 1, wherein the velocity of closing of said blow-off valve is reduced stepwise by said gradient limiter with a plurality of switching steps as a working point approaches the blow-off line.

4. A process in accordance with claim 1, wherein the velocity of closing of said blow-off valve is continuously reduced by a continuously variable limit value for the gradient as a working point approaches the blow-off line.

5. A process in accordance with claim 1, wherein a position of the said blow-off valve is fed back to a surge limit regulator which regulates said compressor.

6. A process in accordance with claim 1, wherein a surge limit regulator control line connected to a blow off valve actuator, and a signal of said control line is fed back to said surge limit regulator.

7. A device for operating a dynamic-type compressor for avoiding regulator instabilities in surge limit regulations with high proportional amplification of the regulator, the device comprising:

a blow-off valve connected to a discharge line of said compressor;

valve actuating means for opening and closing said blow-off valve;

a surge limit regulator for adjusting said blow-off valve via said valve actuating device;

a control line connecting said surge limit regulator to said valve actuator for operating the blow-off valve as needed in the opening and closing directions; and an electronic gradient limiter inserted between said surge limit regulator and said control line.

8. A device in accordance with claim 7, wherein:

said valve actuating device includes one of a pneumatic and hydraulic operating device with a position regulator having one of a piston-and-cylinder unit and a membrane-and-cylinder unit;

a pressure medium is connected to said valve actuating device;

said surge limit regulator adjusts said blow-off valve via said pressure medium and said valve actuating device;

said control line connects said surge limit regulator to said pressure medium for operating said blow-off valve as needed in said opening and closing directions.

9. A device in accordance with claim 7, wherein:

said surge limit regulator determines a control parameter from measured values of a flow through the compressor, compressor discharge pressure, and a presettable desired value, wherein said control parameter is based on a compressor surge limit, said surge limit regulator generates a signal controlling opening and closing of said valve based on said control parameter;

said gradient limiter limits a gradient of said signal when said signal controls closing of said valve, and said surge limit regulator directly controls said valve when said signal controls opening of said valve.

10. A device in accordance with claim 9, wherein:

said gradient limiter causes a closing velocity of said valve to decrease with decreasing distance between a working point and said surge limit of the compressor.

11. A device in accordance with claim 7 wherein said gradient limiter comprises a gain, a limiter, and an integrator.

12. A device in accordance with claim 11, further comprising a feedback branching off said gain after said integrator.

13. A device in accordance with claim 7, further comprising a return line for displaying a position of said blow-off valve, said return line being connected between said actuating device and said surge limit regulator.

14. A device in accordance with claim 7, wherein said control line is coupled with said return line via said actuating device.

15. A process for operating a dynamic-type compressor, the process comprising the steps of:

determining a control parameter from measured values of a flow through the compressor, compressor discharge pressure, and a presettable desired value, wherein said control parameter is based on a compressor surge limit;

regulating the compressor to avoid compressor surge by means of blow-off via a valve, said regulating including generating a signal controlling opening and closing of said valve based on said control parameter, said regulating also including limiting a gradient of said signal when said signal controls closing of said valve and directly controlling said valve by said signal when said signal controls opening of said valve.

16. A process in accordance with claim 15, wherein:

said limiting is of a magnitude for avoiding regulator instabilities in surge limit regulations with high proportional amplification of the regulator.

17. A process in accordance with claim 15, wherein:

said signal is of an amplification to cause instabilities in said regulating of the compressor without said limiting.

18. A process in accordance with claim 15, wherein:

a closing velocity of said valve decreases with a decreasing distance between a working point and a surge limit of the compressor.

* * * * *